US009976090B2

(12) United States Patent
Spaeth

(10) Patent No.: US 9,976,090 B2
(45) Date of Patent: May 22, 2018

(54) METHODS FOR REDUCING SURFACE FOULING IN FUEL PRODUCTION SYSTEMS

(71) Applicant: CHEMTREAT, INC., Glen Allen, VA (US)

(72) Inventor: Vince Spaeth, Ashland, VA (US)

(73) Assignee: CHEMTREAT, INC, Glen Allen, VA (US)

( * ) Notice: Subject to any disclaimer, the term of this patent is extended or adjusted under 35 U.S.C. 154(b) by 565 days.

(21) Appl. No.: 14/531,267

(22) Filed: Nov. 3, 2014

(65) Prior Publication Data

US 2015/0122628 A1 May 7, 2015

Related U.S. Application Data

(60) Provisional application No. 61/899,155, filed on Nov. 1, 2013.

(51) Int. Cl.

| | |
|---|---|
| ***C10B 43/00*** | (2006.01) |
| ***C10B 43/02*** | (2006.01) |
| ***C10B 43/08*** | (2006.01) |
| ***C10B 43/14*** | (2006.01) |

(52) U.S. Cl.

CPC ..... *C10B 43/00* (2013.01); *C10B 43/02* (2013.01); *C10B 43/08* (2013.01); *C10B 43/14* (2013.01)

(58) Field of Classification Search

CPC ..... C10B 43/08; C10B 43/14

See application file for complete search history.

(56) References Cited

U.S. PATENT DOCUMENTS

| | | | | |
|---|---|---|---|---|
| 5,225,002 | A | 7/1993 | Stafford et al. | |
| 6,375,831 | B1 | 4/2002 | Doyle et al. | |
| 2005/0139238 | A1* | 6/2005 | Ferrara | B08B 9/00 134/22.11 |

FOREIGN PATENT DOCUMENTS

| | | |
|---|---|---|
| JP | 58-75694 | 5/1983 |

OTHER PUBLICATIONS

Feb. 22, 2016 International Preliminary Report on Patentability issued in International Application No. PCT/US2014/063693.
Jan. 21, 2015 International Search Report issued in PCT/US2014/063693.
Jan. 21, 2015 Written Opinion issued in PCT/US2014/063693.
Oct. 14, 2016 Office Action issued in Canadian Patent Application No. 2,927,279.
Nov. 3, 2015 Written Opinion issued in International Application No. PCT/US2014/063693.
Jun. 12, 2017 Office Action issued in Canadian Patent Application No. 2,927,279.

* cited by examiner

*Primary Examiner* — Renee Robinson
(74) *Attorney, Agent, or Firm* — Oliff PLC

(57) ABSTRACT

Methods for preventing or reducing fouling of equipment having a metal surface that contacts a reaction byproduct in a fuel production system are provided. The method may include treating the metal surface in the fuel production system by contacting a fouling inhibitor with the metal surface. The fouling inhibitor includes a bicyclic organic compound with an aromatic ring and a heterocyclic ring, and is delivered to the metal surface of the system in sufficient amount and for sufficient time to reduce a fouling deposit on at least a portion of the metal surface.

18 Claims, 1 Drawing Sheet

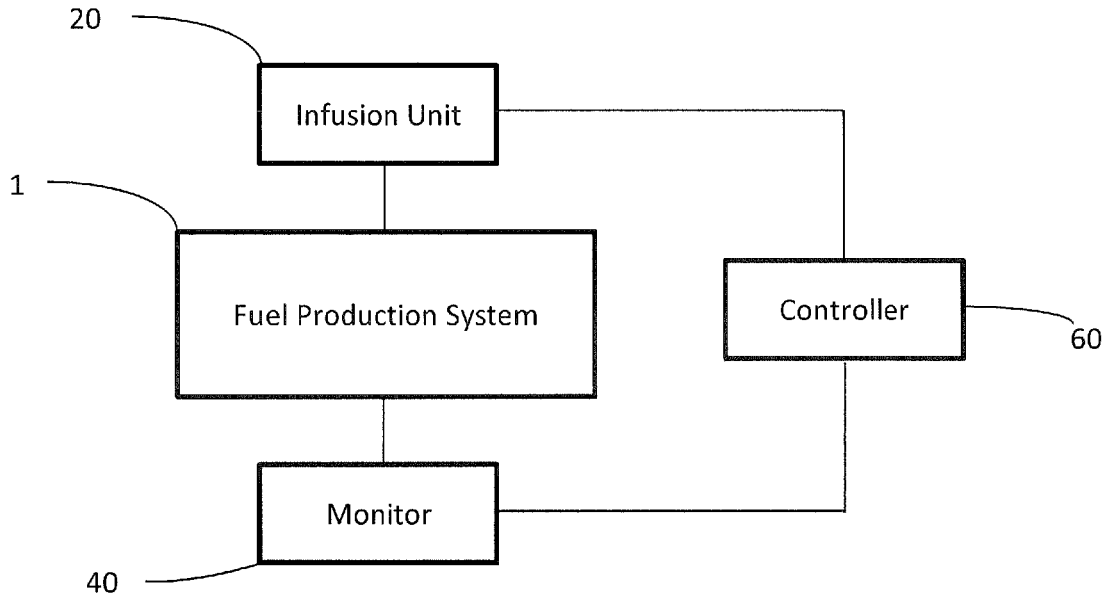
20
Infusion Unit
1
Fuel Production System
Controller
60
Monitor
40

METHODS FOR REDUCING SURFACE FOULING IN FUEL PRODUCTION SYSTEMS

This application claims the benefit of U.S. Provisional Application No. 61/899,155, filed Nov. 1, 2013. The disclosure of the prior application is hereby incorporated by reference herein in its entirety.

TECHNICAL FIELD

This application is directed to methods for treating equipment used in fuel or steel production systems, such as heat exchangers, pipes, boiler equipment and the like. More specifically, this application is directed to treating equipment to reduce surface fouling.

BACKGROUND

Surface fouling of metallic surfaces used in equipment for fuel or steel production systems, such as systems for manufacturing coke or coke byproducts, is a significant problem. Historically, recapture of coke oven byproducts during coke manufacturing was an economically important element of the coke manufacturing process because the byproducts were useful in other applications in agriculture and in the chemical industry. Today, the main emphasis of modern coke byproduct plants is treating the coke oven gas sufficiently so that it can be used as a clean, environmentally friendly fuel. As such, efficient systems and methods for coke production are highly desirable.

As coal is converted into coke, volatile matter in the coal is vaporized and driven off. This volatile matter leaves the coke oven chambers as hot, raw coke oven gas. Raw coke oven gas typically contains a variety of organic and inorganic contaminants including tar, light oils (BTX), naphthalene, ammonia, hydrogen sulfide and hydrogen cyanide. In order to make raw coke oven gas suitable as a fuel gas, a series of processes is typically performed including cooling the coke oven gas to condense out water vapor and contaminants, removing tar to prevent or reduce gas line and equipment fouling, removing ammonia to prevent gas line corrosion, and removing naphthalene to prevent gas line fouling by condensation. Generally, these processes involve gas and liquid treatment.

Gas treatment in coke manufacturing includes some basic processes and equipment for achieving the desired processing of the raw coke oven gas and the associated processing of additional product streams constituting one or more materials removed from the coke oven gas. Treating raw coke oven gas typically involves cooling the gas to remove water vapor and reduce its volume. As the coke oven gas is cooled, a portion of the higher boiling components of the stream including, for example, water, tar and naphthalene condense and are removed from the gas stream. This condensate collects in the primary cooler system and can be a source of surface contamination or fouling on the heat exchanger tubes and other downstream equipment surfaces. Additionally, contaminants such as tar vapor condense and form aerosols that are carried along with the gas flow and ultimately foul downstream surfaces. In the case of heat exchanger surfaces, reduction of heat transfer efficiency results in undesirable downtime and maintenance expense in order to remove the fouling deposits.

Other gas treatment processes include ammonia removal through ammonium sulfate crystallization, ammonia scrubbing and absorption. Further, a final cooler is sometimes used for removing the heat of compression from the coke oven gas that is added as the gas flows through the exhauster.

During the final cooler operation, when the coke oven gas is cooled below the outlet temperature of the primary cooler, naphthalene will condense from the gas. This naphthalene readily crystallizes out from the cooling medium and can foul equipment. Sometimes wash oil is applied in the final coolers to dissolve the naphthalene, and a side stream of oil is steam-stripped to remove the naphthalene. Light oils may be removed in a similar fashion.

Liquid treatment processes use a flushing liquor that circulates between the byproduct plant and the coke oven battery. The tar and liquor plant may also process waste water generated by the coke making process and resulting from coal moisture and chemically bound water in the coal. The flushing liquor flows into tar decanters where the tar separates out from the water and is pumped to storage for later sale. Heavier solid particles separate out from the tar layer and are removed as tar decanter sludge. The aqueous liquor may be then pumped back to the battery, with a portion bled off from the circuit as "excess liquor" or waste water. This liquid contains ammonia and, after the further removal of tar particles, it is steam stripped in a still.

The above-described gas and liquid treatment processes lead to surface fouling of equipment that reduces system efficiency by negatively impacting system uptime and equipment longevity.

SUMMARY

It is an object of this disclosure to provide an effective and environmentally friendly anti-surface fouling program that can be cost-effectively applied to the infrastructure of industrial fuel production systems, including individual components, through the application of bicyclic organic fouling inhibitors that include an aromatic ring and a heterocyclic ring. These bicyclic compounds are organic solvents. The present inventors have discovered that these bicyclic compounds are uniquely suited for dissolving foulants formed from reaction byproducts in industrial fuel production systems. These compounds dissolve organic-based foulants and remove deposits from the surfaces of equipment thereby increasing productivity and lifespan of equipment in industrial fuel production systems.

In a first embodiment, there is provided a method of preventing or reducing fouling of equipment having a metal surface that contacts a reaction byproduct gas stream in a fuel production system. The method may include infusing a fouling inhibitor composition in the byproduct gas stream, the fouling inhibitor composition containing a bicyclic organic compound with an aromatic ring and a heterocyclic ring; and causing the fouling inhibitor treatment composition to contact the metal surface by flowing the byproduct gas stream including the fouling inhibitor composition over the metal surface for a treatment period that is sufficient to reduce a hydrocarbon fouling deposit on at least a portion of the metal surface.

In another embodiment, there is provided a method of preventing or reducing fouling of equipment having a metal surface that contacts a reaction byproduct liquid stream in a fuel production system. The method may include infusing a fouling inhibitor composition in the byproduct liquid stream, the fouling inhibitor composition containing at least 75 percent by weight of a bicyclic organic compound with an aromatic ring and a heterocyclic ring; and causing the fouling inhibitor treatment composition to contact the metal surface by flowing the byproduct liquid stream including the fouling inhibitor composition over the metal surface for a treatment period that is sufficient to reduce a hydrocarbon fouling deposit on at least a portion of the metal surface.

In another embodiment, there is provided a method of preventing or reducing fouling of equipment having a metal surface that contacts a reaction byproduct stream in a fuel production system. The method may include infusing a fouling inhibitor composition into a bath, the fouling inhibitor composition containing a bicyclic organic compound with an aromatic ring and a heterocyclic ring; and causing the fouling inhibitor treatment composition to contact the metal surface by bathing the equipment having the metal surface in the bath for a treatment period that is sufficient to reduce a hydrocarbon fouling deposit on at least a portion of the metal surface.

In another embodiment, there is provided a method of treating a metal surface that is prone to hydrocarbon fouling. The method may include contacting the metal surface with a fouling inhibitor composition that includes quinoline, wherein the fouling inhibitor composition is at least 75 percent by weight of quinoline.

BRIEF DESCRIPTION OF THE DRAWINGS

FIG. 1 is a schematic diagram of a control system for controlling the infusion of fouling inhibitor in a fuel production system according to an embodiment.

DETAILED DESCRIPTION

Overview

Treating raw coke oven gas as a reaction byproduct of a carbon cooking or coking process includes cooling the gas to remove water vapor and reduce its volume. This operation may be conducted in one or more primary coolers that are configured in one of two basic types, direct spray coolers or indirect tube coolers. In a spray cooler, the coke oven gas is cooled by direct contact with a recirculated water spray. The contact cooling water is, in turn, cooled in external heat exchangers. In the indirect tube coolers, the coke oven gas is cooled indirectly by flowing across the outer surface(s) of a series of tubes through which cooling water is pumped. With indirect cooling, the cooling water does not come into contact with (and is not contaminated by) the coke oven gas so the water can be cooled in open conditions using, for example, a cooling tower.

In a byproduct coke oven, the evolved coke oven gas leaves the coke oven chambers at high temperatures approaching 2000° F. This hot gas may be immediately quenched by direct contact with a spray of flushing liquor. The resulting cooled gas is water saturated, incorporating evaporated flushing liquor, and has a cooler temperature, often near 1760° F. This gas is collected in the coke oven battery gas collecting main. From the gas collecting main, the raw coke oven gas flows into the suction main.

The amount of flushing liquor sprayed into the hot gas leaving the oven chambers is often far more than required for cooling, and the remaining unevaporated flushing liquor provides a liquid stream in the gas collecting main that serves to flush away condensed tar and other compounds. This stream of flushing liquor typically flows under gravity into the suction main along with the raw coke oven gas. The raw coke oven gas and the flushing liquor are then separated using a drain pot (also referred to as the downcomer) in the suction main. The flushing liquor and the raw coke oven gas then flow separately to the byproduct plant for treatment.

Fouling Inhibition Mechanisms

Embodiments of the disclosed methods may include treating equipment in an industrial fuel production system such as, for example, a coke oven, with a treatment composition including a fouling inhibitor for a sufficient time and sufficient amount to dissolve organic deposits and resist further fouling while the system is in service, e.g., during or after operation. Alternatively, the treatment composition may be recirculated in solution through individual equipment components to reduce fouling prior to periods of storage, lay-up, or out-of-service conditions. As a result, the system may be brought into service or back into service and operated substantially deposit-free. The equipment may be treated on-line, before start-up, or off-line at any time.

In preferred embodiments, the fouling inhibitor may include an organic solvent with a bicyclic organic compound with an aromatic ring and a heterocyclic ring. Fouling inhibitors particularly suitable for use with the disclosed methods are preferably bicyclic compounds with at least one heterocyclic nitrogen-containing ring and at least one aromatic ring. Preferably these compounds have high boiling points, e.g., more than 150° C. at 1 atm, and more preferably more than 200° C. at 1 atm. In preferred embodiments, quinoline is the fouling inhibitor.

Quinoline has been found to be an unexpectedly effective fouling inhibitor when used according to the embodiments disclosed herein. Quinoline is a colorless hygroscopic liquid with a strong odor and a boiling point of 237° C. at 1 atm. Quinoline is a bicyclic aromatic organic compound with the chemical formula $C_9H_7N$ and the structure illustrated below:

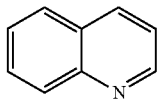

The deposition of the quinoline or quinoline-based solutions on surfaces where foulants are deposited in the form of organic films from, for example, tar and heavy organics, reduces the viscosity of the foulants. This reduced viscosity and/or increased solubility allows the fouled surfaces to shed the foulants, which can then be removed along with other accumulated liquids from the system via, for example, the bottoms of distillation columns, the condensate from heat exchangers or the drip legs of transmission lines.

Fouling Inhibition Methods

In a first embodiment of the disclosed methods for reducing fouling, the method may include feeding a treatment composition including the fouling inhibitor, quinoline, or a quinoline solution, into a gas stream of the system. Depending on the particular system, the feeding can be implemented in several ways. As such, controlling the feeding can be important in arriving at the optimal treatment plan for a particular system. The concentration of the fouling inhibitor in the gas stream during the treating step may depend on properties of the foulants and will be considered in setting the dosage rates to ensure that a sufficient quantity of the fouling inhibitor particles are applied to prevent or suppress the accumulation of a fouling film. The bicyclic compounds used as fouling inhibitors may be dosed in the gas at concentrations of, for example, 0.05 to 100 pints/million cubic feet of gas, 0.1 to 10 pints/million cubic feet of gas, or more preferably, 1 to 5 pints/million cubic feet of gas. The bicyclic compound in the fouling inhibitor composition according to this embodiment may be between 20% and 100% by weight, or more preferably, 75% to 95%. The treatment duration where the fouling inhibitor is present in the gas stream during the gas treating step may be, for example, from about 4 hours to 2 weeks, from 12 hours to 1 week, or more preferably, 24 hours to 100 hours. The treatment time and duration may depend on whether treatment is for clean-up of existing deposits or for maintenance prevention of deposits. For clean-up, dosage will be increased to a higher end of the range and duration may be targeted for from a few days to a few weeks. Maintenance dosing is on-going at lower levels of treatment dosage and duration.

The method and manner by which the fouling inhibitor is fed or infused into the fuel production system is not particularly limited by this disclosure. Conventional hydraulic, mechanical or pneumatic injection means can be utilized for successfully atomizing the quinoline composition into a gas stream. In preferred embodiments, the quinoline is atomized pneumatically or hydraulically to suitable particle size range for optimal carry in the gas stream. Generally, finer particle sizes are preferred and may be on the order of 0.01 to 200 μm or 0.1 to 10 μm once fed into the gas stream. These particle sizes should provide sufficient carrying distances for most applications. As will be appreciated, a number of factors including, for example, the bicyclic compound used, any solvent, the size distribution of the aerosol particles, the temperature, velocity and turbulence of the gas stream will affect the carrying distance of the fouling inhibitor particles.

The injection conditions and location(s) may then be adjusted accordingly to ensure that a sufficient quantity of the fouling inhibitor particles reaches the surfaces that are to be protected by the method. For example, to prevent fouling of heat exchange surfaces within a heat exchanger, an aerosol can be formed by injecting a quinoline solution into the gas feed line so that the aerosol is formed before the gas enters the heat exchanger or, alternatively, by injecting the quinoline solution directly into the heat exchanger through one or more injection ports. Depending on the configuration of the heat exchanger, the direct injection option may provide for improved deposition of quinoline on the protected surfaces and/or provide for targeted application for regions of particular concern.

In a transmission line, for example, a series of injectors could be arranged along its length to ensure that a sufficient quantity of the fouling inhibitor is available for suppressing fouling along the entire length of the line. The use of multiple injection sites would, for example, allow the injection rates to be tailored to provide additional protection in more critical portions of the line and/or those portions of the line that have more complex configurations or are particularly at risk for narrowing or contaminant accumulation.

The fouling inhibitor may be injected into one or more gas streams under conditions that produce an aerosol of fouling inhibitor droplets injected into a liquid stream or applied directly to a contaminated surface. In those methods utilizing the quinoline aerosol, the droplets are then carried in the gas stream until coming into contact with an internal metal surface of the fuel production system. In some embodiments, the droplets accompany potential contaminants and contact the internal surface with the potential contaminants.

Variations may include the use of an absorber in which the fouling inhibitor solution is sprayed into the gas or the use of a saturator in which the gas is bubbled through a bath of the solution.

Moreover, control of the treatment while in the system is not particularly limited. Infusion control, including frequency, duration, concentrations, dosing amounts, dosing types and the like, may be controlled manually or automatically through, for example, an algorithm or a non-transitory computer medium executable by, for example, a CPU. FIG. 1 illustrates an exemplary system for controlling infusion of the fouling inhibitor according to this embodiment. As shown in FIG. 1, controller 60 controls the infusion unit 20 for infusing the appropriate frequency, duration, concentrations, dosing amounts, dosing types and the like, of the fouling inhibitor to fuel production system 1.

In another embodiment of the disclosed methods for reducing fouling, the method may include feeding a treatment composition including a fouling inhibitor, such as quinoline, or a quinoline solution, into a liquid stream of the system. As with the first embodiment, the feeding can be implemented in several ways depending on the system and controlling the feeding can be important in arriving at the optimal treatment plan for a particular system. The concentration of the fouling inhibitor in the liquid stream during the treating step according this embodiment may also depend on properties of the foulants and will be considered in setting the dosage rates to ensure that a sufficient quantity of the quinoline particles are applied to prevent or suppress the accumulation of a fouling film. The bicyclic compounds used as fouling inhibitors may be dosed in that liquid at a concentration of, for example, 0.1 to 1000 ppm, 0.5 to 100 ppm, 1 to 50 ppm, or more preferably, 1 to 10 ppm. The bicyclic compound in the fouling inhibitor composition according to this embodiment may be present in amounts of from 20% and 100% by weight, or more preferably, 75% to 95%.

The treatment duration of the fouling inhibitor in the liquid stream during the liquid treating step may be from about 4 hours to 2 weeks, 12 hours to 1 week, or more preferably, 24 hours to 100 hours. The treatment time and duration may depend on whether treatment is for clean-up of existing deposits or for maintenance prevention of deposits. For clean-up, dosage will be increased to a higher end of the range and duration may be targeted for from a few days to a few weeks. Maintenance dosing is on-going at lower levels of treatment dosage and duration.

In this embodiment, the method and manner by which the treatment composition is infused into the water stream is not particularly limited by this disclosure. Treatment can be infused into the liquid stream at any suitable location of the fuel production system. Methods for infusing the fouling inhibitor composition, including controlling the flow of the infusion, may include a multi-valve system or the like, as would be understood by one of ordinary skill in the art. Moreover control of the treatment while in the system is not particularly limited. Infusion control, including frequency, duration, concentrations, dosing amounts, dosing types and the like, may be controlled manually or automatically through, for example, an algorithm or a non-transitory computer medium executable by, for example, a CPU.

In these embodiments, the application of the fouling inhibitor may be continuous or intermittent application and will depend on the degree of fouling in the system. With regard to intermittent application, the fouling inhibitor may be applied for a first time period at a first concentration and during a first time period, and for a second time period at a second concentration and during a second time period. The second concentration and second time period may be lower than the first concentration and the first time period. The degree of fouling in the system may be determined by monitoring the fuel production system through any suitable means known in the art, e.g., by measuring a reduction in heat transfer efficiency of a surface. For example, as shown in FIG. 1, monitor 40 monitors a parameter of the fuel production system 1.

In another embodiment of the disclosed methods for reducing fouling, the method may include applying a treatment composition including a fouling inhibitor, such as quinoline, or a quinoline solution, via a soak method to the system or components of the system such as, for example, heat exchangers, distillation columns and piping. This embodiment may be particularly effective for treating smaller equipment or components separate from the system or components out of service. Soaking may include recirculating the bicyclic compound solution through the equipment using, for example, regular process pump(s), a secondary maintenance pump or a customized cleaning rig configured for receiving the fouled equipment. In preferred embodiments, soaking is conducted in a closed system configured to immerse either partially or completely the fouled equipment. As with the other embodiments, the feeding can be implemented in several ways depending on the equipment.

As will be appreciated, the quinoline concentration, solution temperature and cleaning treatment duration can be modified to address a wide range of equipment and contaminants according to this embodiment. The concentration of the fouling inhibitor during the treating step according this embodiment may also depend on properties of the foulants and will be considered in setting the dosage rates to ensure that a sufficient quantity of the quinoline particles are applied to prevent or suppress the accumulation of a fouling film. The quinoline may be dosed in the soak at a concentration of from about 5% up to 100% concentration, or more preferably, 75% to 100%, depending on deposit type, volume to be treated and time available to remove the deposit. The duration of the fouling inhibitor in the solution during the soak treating step may range from a few hours to several days, depending on the nature of deposits, level of deposits and time available. For example, the duration may be from about 4 hours to 2 weeks, 12 hours to 1 week, or more preferably, 24 hours to 100 hours. The soaking treatment solution may be at room temperature or ambient conditions. For example, the soak treating step may be conducted at 10° C. to 35° C., or more preferably, 20° C. to 25° C.

The treatment composition may be infused with one or more other organic solvents in addition to the fouling inhibitor. For example, the treatment composition may include organic based solvents like aromatic naptha-based or another suitable component as it is infused into the gas or liquid stream or the soak solution. The treatment composition may comprise a carrier solvent in a concentration ranging from 19:1 to 1:19 solvent to quinoline.

If desired, additional fouling inhibition and/or gas or water treatment chemistry known in the art can be introduced into the system in conjunction with the treatment compositions to further improve fouling inhibition performance and control deposition of undesirable species. As will be appreciated, the treatment methods according to the disclosure can be paired with other treatment or conditioning chemistries that would be compromised by the continuous presence of the foul inhibitor. Alternatively, "greener" treatment packages or treatment packages designed to address other parameters of the system operation can be utilized along with the treatment feedings to improve the quality of the system effluent and/or reduce the need for effluent treatment prior to discharge.

Referring to FIG. 1, disclosed methods may further comprise measuring a parameter of the metal surface or fuel production system via monitor 40. Disclosed methods may further comprise introducing at least one subsequent dose of the treatment composition via infusion unit 20 and controlling the dissolution of the fouling deposits based on the parameter via controller 60. As will be appreciated, the frequency of the treatment dosing and the inhibitor concentration is a function of the system 1 being treated and can be set and/or adjusted empirically based on test or historical data. The success of the treatment dosing may be evaluated by monitoring the system 1. According to embodiments, the treatment method may further comprise measuring and monitoring a characteristic of the metal surface or system particularly after at least initial treatment or any subsequent dose to determine the timing, duration, concentration and/or frequency of subsequent treatment doses.

In embodiments, the duration of introducing the treatment dose is controlled by controller 60 based on the measured parameter, and the concentration of the fouling inhibitor in the system 1 during any second or subsequent dose is controlled based on the measured parameter. The measured parameter may be indicative of a fouling deposit amount on the metal surface. The measured parameter may be indicative of a dissolution rate of the fouling deposit on the metal surface. For example, the measured parameter may be a hardness value of the deposit, heat transfer of a surface, visual cleanliness, pressure drop reduction, or flow improvement.

Disclosed embodiments may be used in a variety of industrial fuel production systems including, but not limited to, any plant that can deposit organic based deposits in gas lines, process liquor heat exchangers and related piping, oil refineries and chemical plant such as, for example, coke ovens, steel manufacturing plants, smelting plants, and the like.

EXAMPLE

In a first step, 200 ml of solvent was added to a glass beaker for three sample solvents, Samples A, B and C, shown in Table 1 below. A sample of organic deposit (10-20 grams in size) was weighed for specific weight. The organic deposits were then dissolved into each Sample. Each Sample was mixed for 24 hours to obtain visual clarity of the solvent and final weight of the deposit.

TABLE 1

| SAMPLE | DESCRIPTION | VISUAL CLARITY | DEPOSIT WEIGHT LOSS |
|---|---|---|---|
| A | ChemTreat F66 (aromatic naphtha based solvent and surfactant) | Solvent was slightly darker than initially | 22% |
| B | ChemTreat GT101 (aromatic naphtha) | Solvent was slightly darker than initially | 19.5% |
| C | ChemTreat GT103 (100% quinoline solvent) | Solvent was very dirty | 85% |

These data indicate that Sample C (100% quinoline) was much more effective at dissolving the organic deposit by total deposit % weight loss and larger presence of dissolved organics in the solvent (dirtier in appearance) than Samples A and B.

It will be appreciated that the above-disclosed features and functions, or alternatives thereof, may be desirably combined into different systems or methods. Also, various alternatives, modifications, variations or improvements may be subsequently made by those skilled in the art, and are also intended to be encompassed by the following claims. As such, various changes may be made without departing from the spirit and scope of this disclosure as defined in the claims.

What is claimed is:

1. A method of preventing or reducing fouling of equipment having a metal surface that contacts a reaction byproduct gas stream in a fuel production system, the method comprising:

atomizing a fouling inhibitor composition and combining the atomized fouling inhibitor composition with the byproduct gas stream, the fouling inhibitor composition containing 20% to 100% by weight of a bicyclic organic compound with an aromatic ring and a heterocyclic ring; and causing the fouling inhibitor treatment composition to contact the metal surface by flowing the byproduct gas stream including the fouling inhibitor composition over the metal surface for a treatment period that is sufficient to reduce a hydrocarbon fouling deposit on at least a portion of the metal surface, wherein the bicyclic organic compound is present in the byproduct gas stream at a concentration in the range of 0.05 to 100 pints per million cubic feet (0.836 to 1,670 ml/million liters) of gas during the treatment period.

2. The method of preventing or reducing fouling according to claim 1, wherein the treatment period is from 12 hours to 1 week.

3. The method of preventing or reducing fouling according to claim 1, wherein the treatment period is from 24 hours to 100 hours.

4. The method of preventing or reducing fouling according to claim 1, wherein the heterocyclic ring is a nitrogen-containing ring.

5. The method of preventing or reducing fouling according to claim 1, wherein the concentration of the bicyclic organic compound in the byproduct gas stream is in the range of 0.1 to 10 pints/million cubic feet (1.67 to 167 ml/million liters) during the treatment period.

6. The method of preventing or reducing fouling according to claim 5, wherein the concentration of the bicyclic organic compound in the byproduct gas stream is in the range of 1 to 5 pints/million cubic feet (16.7 to 83.5 ml/million liters) during the treatment period.

7. The method of preventing or reducing fouling according to claim 1, wherein the fouling inhibitor composition is at least 75 percent by weight of the bicyclic organic compound.

8. The method of preventing or reducing fouling according to claim 1, wherein the fouling inhibitor composition is at least 95 percent by weight of the bicyclic organic compound.

9. The method of preventing or reducing fouling according to claim 1, wherein the fouling inhibitor composition is 100 percent by weight of the bicyclic organic compound.

10. The method of preventing or reducing fouling according to claim 1, wherein the bicyclic organic compound is quinoline.

11. The method of preventing or reducing fouling according to claim 1, wherein the treatment period is a clean-up period.

12. The method of preventing or reducing fouling according to claim 1, wherein the fouling inhibitor composition further comprises at least one secondary fouling inhibitor compound.

13. The method of preventing or reducing fouling according to claim 12, wherein the secondary fouling inhibitor compound is naphtha-based.

14. The method of preventing or reducing fouling according to claim 1, wherein the equipment is a heat exchanger.

15. The method of preventing or reducing fouling according to claim 1, further comprising monitoring a parameter of the system that is indicative of the presence of fouling deposits after the treatment period.

16. The method of preventing or reducing fouling according to claim 15, further comprising causing the fouling inhibitor treatment composition to contact the metal surface for a second treatment period, the timing of the second treatment period being based on the measured parameter.

17. The method of preventing or reducing fouling according to claim 1, wherein the system is on-line during the treatment period.

18. A method of treating a metal surface that is prone to hydrocarbon fouling, the method comprising atomizing a fouling inhibitor composition that includes quinoline and contacting the metal surface with a gas stream containing the atomized fouling inhibitor composition, wherein the fouling inhibitor composition is at least 75 percent by weight of quinoline and the quinoline is present in the gas stream at a concentration in the range of 0.05 to 100 pints per million cubic feet (0.836 to 1,670 ml/million liters) of gas.

* * * * *